US009121413B2

(12) United States Patent
Roush et al.

(10) Patent No.: US 9,121,413 B2
(45) Date of Patent: Sep. 1, 2015

(54) VARIABLE LENGTH COMPRESSOR ROTOR PUMPING VANES

(75) Inventors: Eric David Roush, Simpsonville, SC (US); Suresh Shankaranarayana Rao, Karnataka (IN); Andrew Clifford Hart, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 662 days.

(21) Appl. No.: 13/427,002

(22) Filed: Mar. 22, 2012

(65) Prior Publication Data

US 2013/0251528 A1 Sep. 26, 2013

(51) Int. Cl.
*F04D 29/32* (2006.01)
*F04D 29/58* (2006.01)

(52) U.S. Cl.
CPC ..... *F04D 29/321* (2013.01); *F04D 29/329* (2013.01); *F04D 29/584* (2013.01)

(58) Field of Classification Search
CPC ..... F04D 29/32; F04D 29/321; F04D 29/584; F04D 29/329; F01D 1/06; F01D 1/08; F01D 25/10; F01D 25/12
USPC ..... 415/115, 116, 120
See application file for complete search history.

(56) References Cited

U.S. PATENT DOCUMENTS 2,618,433 A * 11/1952 Loos et al. ..... 415/115
2,910,268 A * 10/1959 Davies et al. ..... 415/115
2,988,325 A * 6/1961 Dawson ..... 415/110
4,127,988 A * 12/1978 Becker ..... 60/726
4,595,339 A * 6/1986 Naudet ..... 416/95
4,919,590 A * 4/1990 Stratford et al. ..... 415/116
5,143,512 A 9/1992 Corsmeier et al.
5,997,244 A * 12/1999 Gebre-Giorgis et al. ..... 415/115
6,808,362 B1 10/2004 Glahn et al.
6,857,851 B2 * 2/2005 Avignon et al. ..... 415/116
6,908,278 B2 * 6/2005 Brunet et al. ..... 415/115
7,552,590 B2 * 6/2009 Drevs et al. ..... 60/785
2003/0133788 A1 7/2003 Avignon et al.
2009/0282834 A1 * 11/2009 Hein ..... 60/772

(Continued)

FOREIGN PATENT DOCUMENTS

DE 196 17 539 B4 11/1997
DE 19617539 A1 * 11/1997 ..... F01D 25/12

(Continued)

OTHER PUBLICATIONS

EP Search Report and Written Opinion issued May 16, 2014 in connection with corresponding EP Patent Application No. 13160047.0.

*Primary Examiner* — Dwayne J White
*Assistant Examiner* — William Grigos
(74) *Attorney, Agent, or Firm* — Nixon & Vanderhye P.C.

(57) ABSTRACT

A compressor rotor includes a rotor body mounting a disk supporting an array of blades on a radially outer surface of the disk in a primary flow path. A radially inner portion of the disk is formed with an annular array of radially extending vanes adapted to move cooling air flowing in a secondary flow path from a radially-inward direction to an axial direction at a substantially center portion of said disk. Some of said radially-extending vanes have relatively longer radial lengths and some of the radially extending vanes having relatively shorter radial lengths to thereby provide a sufficient flow area while also lessening the formation of vortices along the vanes.

20 Claims, 4 Drawing Sheets

(56) References Cited

U.S. PATENT DOCUMENTS

| | | | | |
|---|---|---|---|---|
| 2009/0324386 | A1 | 12/2009 | Takamura et al. | |
| 2011/0123325 | A1 * | 5/2011 | Morris et al. | 415/208.1 |

FOREIGN PATENT DOCUMENTS

| | | | |
|---|---|---|---|
| DE | 102008029528 | A1 | 12/2009 |
| FR | 2614654 | A1 | 11/1988 |

* cited by examiner

VARIABLE LENGTH COMPRESSOR ROTOR PUMPING VANES

BACKGROUND OF THE INVENTION

Compressor and turbine rotor design often requires moving air from a high (or greater) radius location to a low (or lesser) radius location. For example, a fraction of the compressor air in the main flowpath through the various stages of a compressor, is directed radially inwardly to an axially-oriented passage along the rotor. This secondary flow path supplies cooling air to the buckets in the various stages of the axially-aligned turbine section. Moving air from a higher radius to a lower radius requires the use of a rotor feature to prevent the air from free-vortexing and losing excess pressure. A common problem is that as the radius of the pumping vanes decreases, the available space for flow and the anti-swirl feature becomes limited.

The ideal impeller for radially-inflowing circuits should extend downwardly to the same radius as the axial wheel bore to which the air is being transferred. Any distance between the bottom of the impeller and the bore radius will cause the tangential velocity of the air to exceed that of the wheel. This causes higher than desired pressure losses. In addition, high-tangential velocities comprise instabilities in the flow field. Typically a flow area is limited by the axial space between the two wheels and thickness of the impellers.

There remains, therefore, a need for a compressor rotor ring configuration that provides the desired flow area that avoids excess pressure drop.

BRIEF SUMMARY OF THE INVENTION

In accordance with an exemplary but nonlimiting embodiment, the invention provides compressor rotor comprising a rotor body mounting a disk supporting an array of blades on a radially outer surface of the disk in a primary flow path; a radially inner portion of the disk formed with an annular array of radially extending vanes adapted to move cooling air flowing in a secondary flow path from a radially-inward direction to an axial direction at substantially a center portion of the disk, some of the radially-extending vanes having relatively longer radial lengths and some of the radially extending vanes having relatively shorter radial lengths.

In another aspect, there is provided a compressor rotor comprising a rotor body mounting a disk supporting an array of blades on a radially outer surface of the disk in a primary flow path; a radially inner portion of the disk formed with an annular array of radially extending vanes adapted to move cooling air flowing in a secondary flow path from a radially-inward direction to an axial direction at substantially a center portion of the disk, some of the radially-extending vanes having relatively longer radial lengths and some of the radially extending vanes having relatively shorter radial lengths; wherein all of the vanes are concavely curved in the radial direction; and further wherein the vanes of relatively longer radial lengths and the vanes of relatively shorter radial lengths alternate about the disk.

In still another aspect, there is provided a method of controlling cooling flow in a secondary flow path in a compressor, the secondary flow path extending radially inward from a substantially axially-oriented primary flow path to an axial passage surrounding or adjacent a compressor rotor, the method comprising: providing a compressor rotor disk with pumping vanes arranged annularly about the axial passage, and extending radially toward the axial passage, some of the pumping vanes having relatively longer radial lengths and some of the pumping vanes having relatively shorter radial lengths; and feeding air radially into flow areas occupied by the pumping vanes whereby the cooling air turns from a radial direction to the substantially axial direction.

The invention will now be described in detail in connection with the drawings identified below.

DETAILED DESCRIPTION OF THE INVENTION

Figure 1:
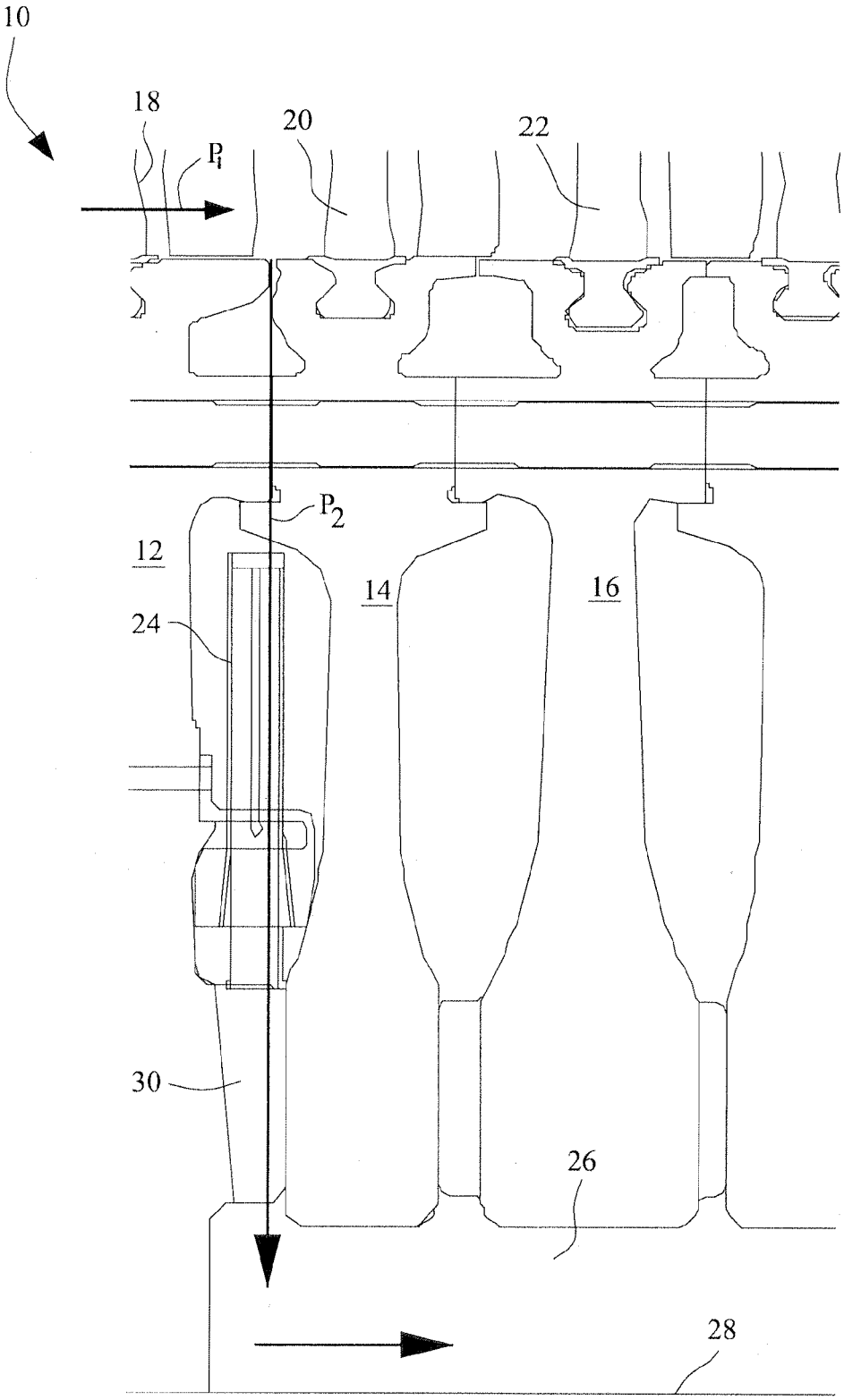
FIG. 1 is a simplified schematic showing a secondary airflow path from the compressor vanes radially inwardly to an axial passageway and including compressor rotor pumping vanes in accordance with an exemplary but nonlimiting embodiment of the invention.

Referring to FIG. 1, a compressor 10 is partially shown in simplified form to include a series of rotor disks 12, 14, 16, etc., each supporting a row of blades or buckets 18, 20, 22, etc., respectively. Within the space radially inward of the blades or buckets, there are arranged cooling air tubes 24 that supply air extracted from primary flow path P1 radially inwardly along a secondary flow path P2 to an axial passage 26 extending parallel to, or surrounding the rotor 28 (indicated by single line), the passage 26 supplying cooling air to the wheelspaces in the axially downstream turbine engine. The tubes 24 are typically centered between the vanes.

The rotor pumping vanes 30 (one shown) of interest here extend from the face of disk 14 and move the cooling air exiting the tubes 24 into the passage 26. As already noted above, this arrangement can lead to free vortexing and excessive pressure drop as the air moves closer to the passage 28.

Figure 2:
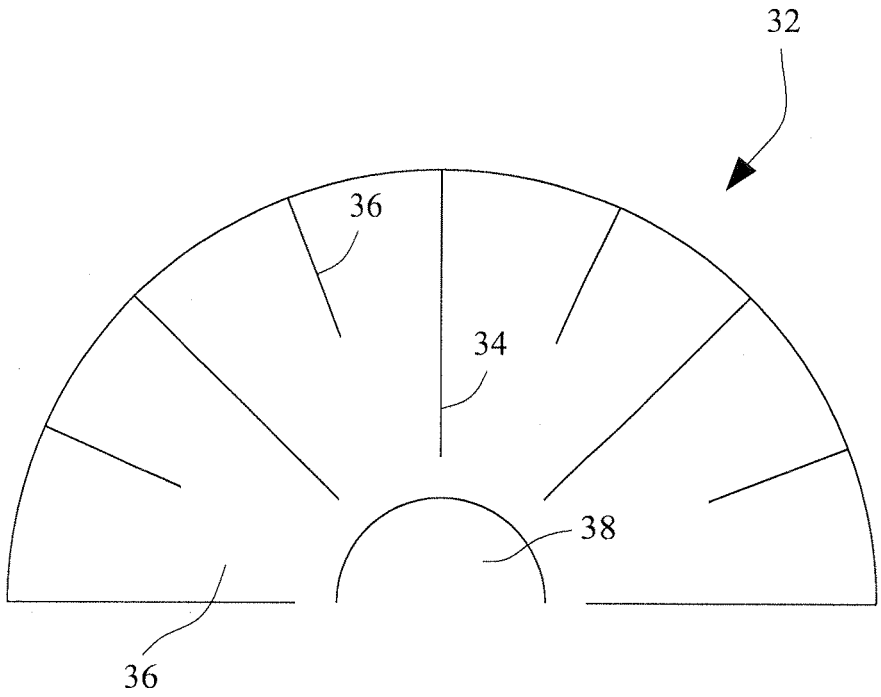
FIG. 2 is a simplified end view of the compressor rotor pumping vanes shown in FIG. 1.

FIG. 2 illustrates in schematic form one exemplary but nonlimiting embodiment of this invention where the rotor pumping vanes 32 at the radially inner end of its respective disk, e.g., disk 12, are shaped and arranged so that relatively longer vanes 34 alternate with relatively shorter vanes 36, in an annular array of radially-oriented vanes guiding air to the axial passage 38. By including a percentage of vanes with shorter radial lengths than other of the vanes, sufficient flow area is provided to minimize the formation of vortices, enable better control of tangential velocities, and prevent excessive pressure drop. In this example, the vanes may be straight and the radial length of the relatively shorter vanes 36 may be from about ¾ to ½ the radial length of the relatively longer vanes 34 (a RL1 to RLs ratio of about 1.5-2:1. In one example, the radially-longer vanes 34 may be about 10 inches in length and the radially-shorter vanes 36 about 7 inches in length. It will be understood, however, that the absolute and relative lengths may vary with specific compressor designs.

Figure 3:
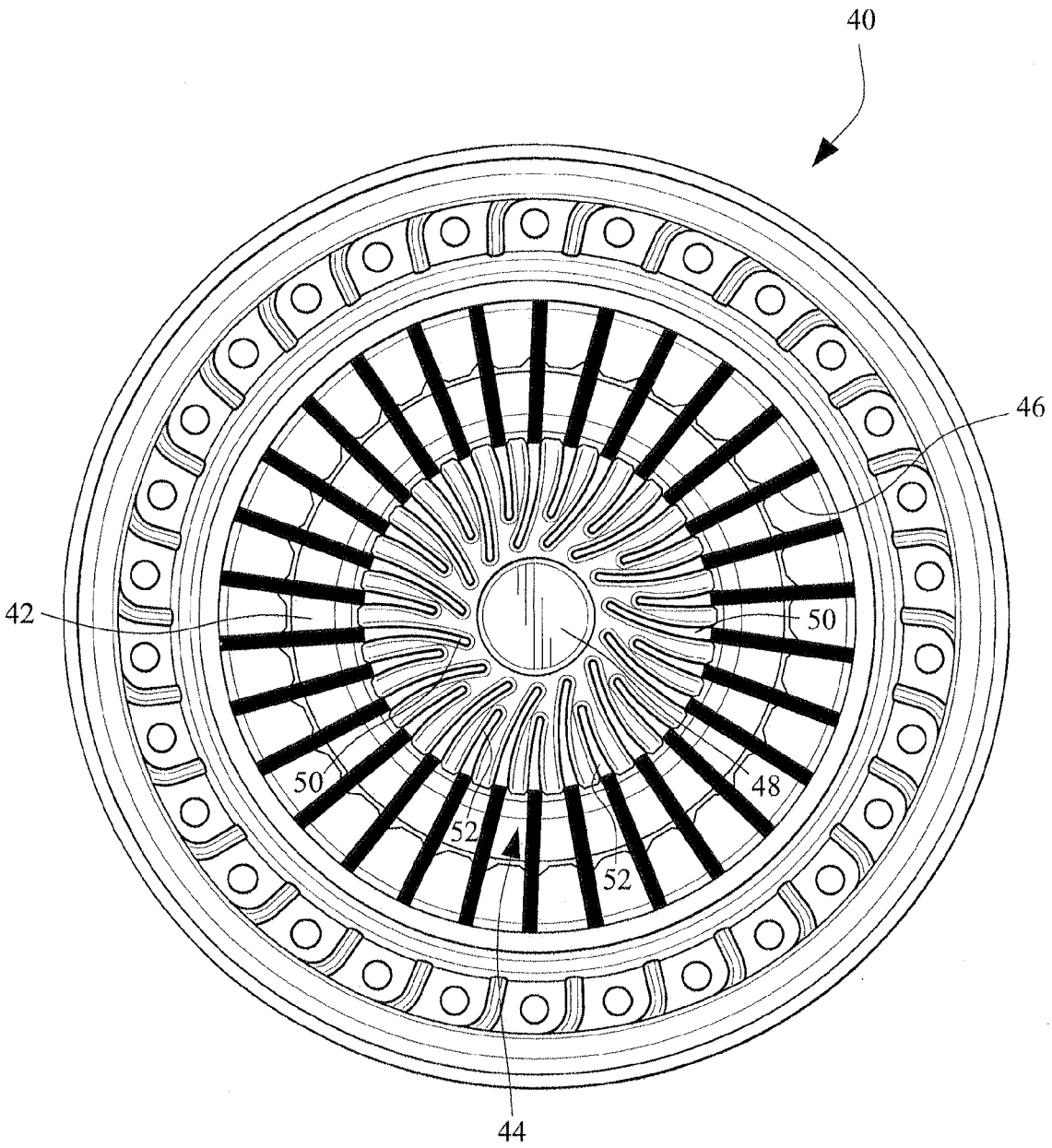
FIG. 3 is an end elevation view of the compressor rotor disk incorporating the pumping vanes in accordance with the exemplary but nonlimiting embodiment.
Figure 4:
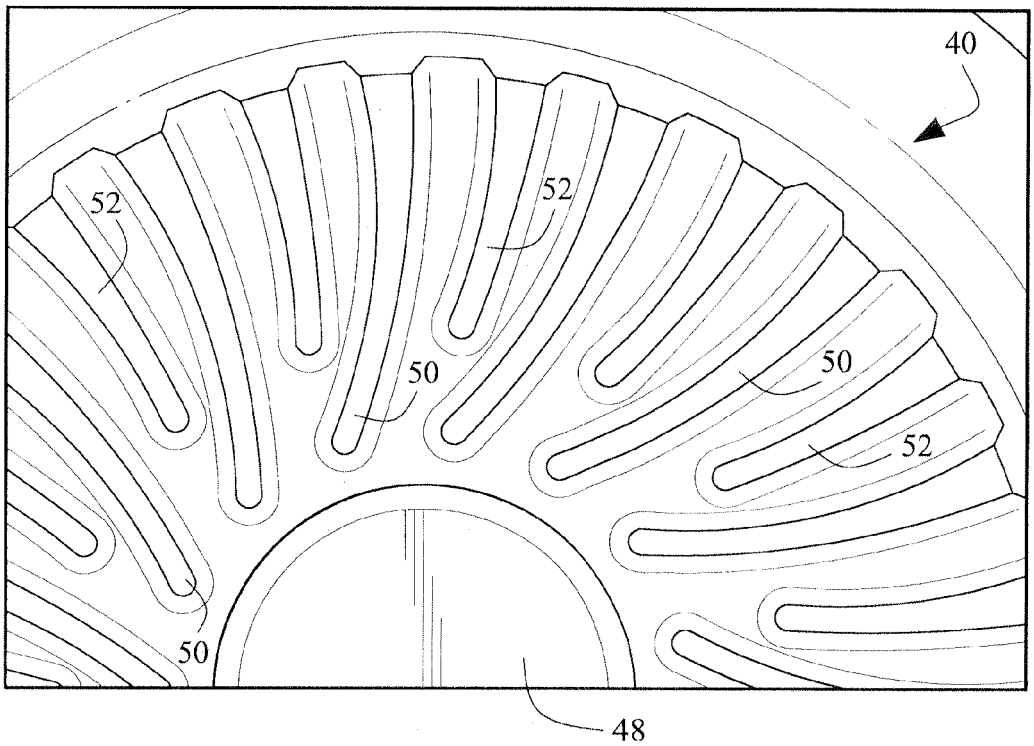
FIG. 4 is a partial perspective view of the compressor rotor disk shown in FIG. 4.
Figure 5:
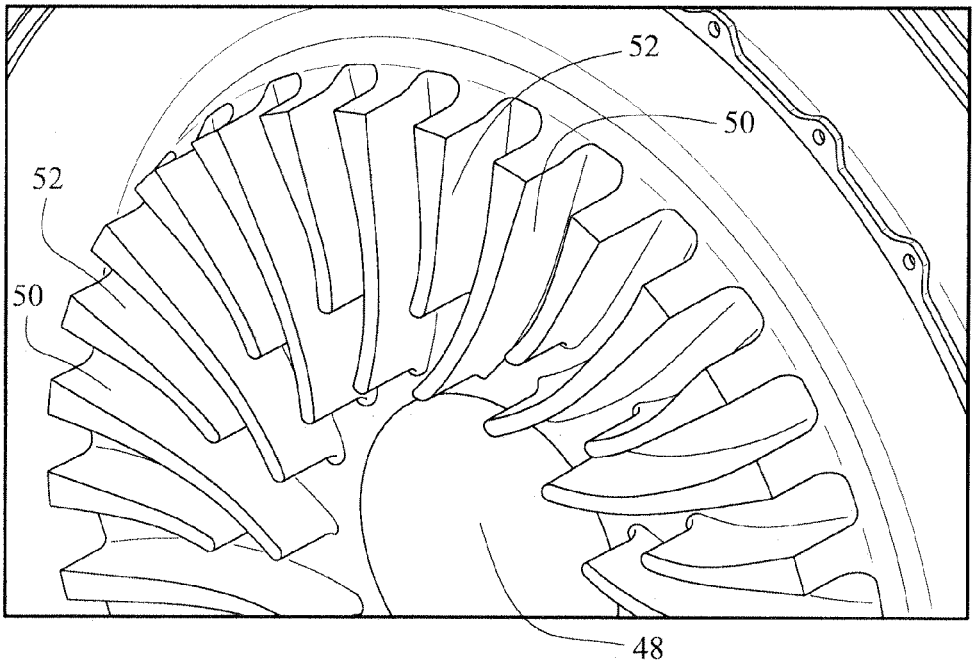
FIG. 5 is another partial perspective view of the compressor rotor disk incorporating the pumping vanes in accordance with the exemplary but nonlimiting embodiment.

FIGS. 3, 4 and 5 illustrate another exemplary but nonlimiting embodiment. In this alternative arrangement, a compressor rotor disk 40 having an end face 42 is formed with axially projecting vanes 44 that direct cooling air into the axial passage 48. FIG. 3 also shows a plurality of radially extending air supply tubes 46 that feed cooling air to the pumping vanes 44 which, in turn, move the cooling air into the internal, axial passage 48.

As in the earlier described embodiment, relatively longer vanes 50 alternate with relatively shorter vanes 52, and in this embodiment, all of the vanes are curved in a circumferential direction. Note that the RL1 to RLs ratio is less than 2:1 in this embodiment, but here again, the ratio may change depending on application.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor rotor comprising:

a rotor body mounting a disk supporting an array of blades on a radially outer surface of the disk in a primary flow path;

an annular array of radially extending air supply tubes covering a radially outer portion of the disk, the air supply tubes extending to at least one half of a radial distance between a radially outer radius of the disk and a radially inner radius of the disk;

a radially inner portion of the disk formed with an annular array of radially extending vanes adapted to move cooling air flowing in a secondary flow path that is supplied by the air supply tubes to flow from a radially-inward direction towards an axial direction at substantially a center portion of said disk, some of said radially-extending vanes having relatively longer radial lengths and some of said radially extending vanes having relatively shorter radial lengths.

2. The compressor rotor of claim 1 wherein all of said radially-extending vanes have substantially uniform thickness.

3. The compressor rotor of claim 2 wherein all of said radially-extending vanes are substantially straight.

4. The compressor rotor of claim 1 wherein the vanes of relatively longer radial lengths and the vanes of relatively shorter radial lengths alternate about the disk.

5. The compressor rotor of claim 1 wherein said axial direction of said secondary flow path is defined by a passage extending along said rotor body.

6. The compressor rotor of claim 5 wherein said vanes of relatively longer radial lengths extend radially inwardly to a location proximate said passage.

7. The compressor rotor of claim 1 wherein all of said air supply tubes are straight and all of said vanes are concavely curved in the radial direction.

8. The compressor rotor of claim 1 wherein a ratio of radial lengths of said vanes of relatively longer radial length and said vanes of relatively shorter lengths is about 2:1.

9. The compressor rotor of claim 4, wherein a plurality of radially-oriented tubes supply air in said secondary flow path to said vanes, wherein each of said plurality of radially-oriented tubes is centered between a pair of adjacent ones of said annular array of radially-extending vanes.

10. A compressor rotor comprising:

a rotor body mounting a disk supporting an array of blades on a radially outer surface of the disk in a primary flow path;

an annular array of radially extending air supply tubes covering a radially outer portion of the disk, the air supply tubes extending to at least one half of a radial distance between a radially outer radius of the disk and a radially inner radius of the disk;

a radially inner portion of the disk formed with an annular array of radially extending vanes adapted to move cooling air flowing in a secondary flow path that is supplied by the air supply tubes to flow from a radially-inward direction towards an axial direction at substantially a center portion of said disk, some of said radially-extending vanes having relatively longer radial lengths and some of said radially extending vanes having relatively shorter radial lengths; wherein all of said air supply tubes are straight and all of said vanes are concavely curved in the radial direction; and further wherein the vanes of relatively longer radial lengths and the vanes of relatively shorter radial lengths alternate about the disk.

11. The compressor rotor of claim 10 wherein said axial direction of said secondary flow path is defined by a passage extending along said rotor body.

12. The compressor rotor of claim 11 wherein said vanes of relatively longer radial lengths extend radially inwardly to a location proximate said elongated bore.

13. The compressor rotor of claim 10 wherein a ratio of radial lengths of said vanes of relatively longer radial length and said vanes of relatively shorter lengths is about 2:1.

14. The compressor rotor of claim 10, wherein a plurality of radially-oriented tubes supply air in said secondary flow path to said vanes, wherein each of said plurality of radially-oriented tubes is centered between a pair of said annular array of radially-extending vanes.

15. A method of controlling cooling flow in a secondary flow path in a compressor, the secondary flow path extending radially inward from a substantially axially-oriented primary flow path to an axial passage surrounding or adjacent a compressor rotor, the method comprising:

providing a compressor rotor disk with air supply tubes arranged annularly about an radially outer portion of the disk and extending radially towards said axial passage, the tubes extending at least one half of a distance between a radially outer radius of the disk and a radially inner radius of the disk;

providing the compressor rotor disk with pumping vanes arranged annularly about said axial passage and extending radially toward said axial passage, some of said pumping vanes having relatively longer radial lengths and some of said pumping vanes having relatively shorter radial lengths; and feeding cooling air through the air supply tubes in a radial direction into flow areas occupied by said pumping vanes whereby the cooling air turns from a radial direction to a substantially axial direction.

16. A method of claim 15 wherein all of said pumping vanes are substantially straight.

17. A method of claim 15 wherein said pumping vanes of relatively longer radial lengths and said pumping vanes of relatively shorter axial lengths alternate about the disk.

18. A method of claim 15 wherein all of said pumping vanes are concavely curved in the radial direction.

19. A method of claim 15 wherein a ratio of radial lengths of said pumping vanes of relatively longer radial length and said pumping vanes of relatively shorter lengths is about 2:1.

20. A method of claim 15 wherein each of said plurality of radially-oriented tubes is centered between a pair of said annular array of said pumping vanes.

* * * * *